United States Patent [19]

Schiller

[11] Patent Number: 4,781,052

[45] Date of Patent: Nov. 1, 1988

[54] ACTUATOR DEVICE FOR AXIALLY MOVING ROLLING MILL ROLLS

[75] Inventor: Günter Schiller, Kreuztal, Fed. Rep. of Germany

[73] Assignee: SMS Schliemann-Siemag Aktiengesellschaft, Dusseldorf, Fed. Rep. of Germany

[21] Appl. No.: 942,552

[22] Filed: Dec. 16, 1986

[30] Foreign Application Priority Data

Dec. 16, 1985 [DE] Fed. Rep. of Germany ..... 3544403

[51] Int. Cl.[4] ..... B21B 31/18; B21B 31/10; B21B 35/14

[52] U.S. Cl. ..... 72/247; 72/238; 72/249

[58] Field of Search ..... 72/247, 245, 243, 241, 72/238, 249

[56] References Cited

FOREIGN PATENT DOCUMENTS 2440495 3/1975 Fed. Rep. of Germany .
2206912 4/1984 Fed. Rep. of Germany .
3504415 8/1986 Fed. Rep. of Germany ..... 72/247
0090306 5/1983 Japan ..... 72/247
0087911 5/1984 Japan ..... 72/247
525041 8/1972 Switzerland .

*Primary Examiner*—Robert L. Spruill
*Assistant Examiner*—Steven B. Katz
*Attorney, Agent, or Firm*—Herbert Dubno

[57] ABSTRACT

Actuator device for axially shifting rolls which can be powered rolls journaled by way of radial bearings in holding elements in a rolling mill frame, uses hydraulic cylinders. At the drive side, the journal portions of the working rolls are respectively stepped to provide a centering roll portion, onto which respectively, an axial bearing is mounted to be positively held in position. At the housing of this bearing is attached a hydraulic cylinder which carries out the adjustment/control operation. The respective locking after mounting a new roll, for example, is achieved by a spindle head which is slipped on and which transmits the motive power of a driving spindle by way of the locking function performed by this spindle.

16 Claims, 2 Drawing Sheets

ACTUATOR DEVICE FOR AXIALLY MOVING ROLLING MILL ROLLS

FIELD OF THE INVENTION

My present invention relates to an actuator for axially displacing the rolls of a rolling mill stand.

More particularly, this invention relates to an actuator device or similar mechanism which can effect axial positioning and setting of the rolls using hydraulic piston and cylinder units, preferably for the powered or driven rolls, for example the working rolls, of a rolling mill stand which may be journalled by radial bearings in holding elements in the rolling mill frame.

BACKGROUND OF THE INVENTION

Equipment for axially shifting rolling mill rolls, particularly for grooved rolls, has been described in Swiss Pat. No. 525,041.

Axial shifting of the rolls of flat-strip or slab rolling mills has been described, for example, in German Patent Document No. 2,206,912. This reference discloses hydraulic piston and cylinder units which serve to move the respective rolls using shafts which extend through the respective comb or grooved rolls and which are arranged behind the rolling mill frame.

A more compact arrangement for moving rolls is described in German Patent Document No. 2,440,495. However, it has been determined that the arrangement of the actuating piston and cylinder units in the mill frame, or in other supports leads to difficulties and may limit the hydraulic piston and cylinder units with respect to size, diameter and, consequently, actuating power.

Furthermore, the need to provide extensions or arms of the holding elements for the rolls which are to be moved, tends to detrimentally interfere during the roll exchange operation or attendant refinishing of the rolls.

OBJECTS OF THE INVENTION

The principal object of this invention is to provide an improved roll actuator or which avoids drawbacks of prior art systems.

It is accordingly an object of the invention to provide an apparatus which allows, with the least amount of effort, a compact arrangement of the axial-displacement device and in which the majority of the actuator components remain generally within the confines of the frame, so that for a given number of roll sets they need be obtained and mounted only once so that in the case of roll change it will no longer be necessary to repeatedly connect and disconnect the respective coupling means.

Furthermore, it is an object of the invention to facilitate inspection of the shifting unit and to enable its repair and replacement as required.

It is also an object of the invention to ensure that those parts which are predominantly subjected to wear can be easily inspected and replaced to minimize any down-time of the mill.

SUMMARY OF THE INVENTION

In accordance with the invention there is provided a device for axially displacing the rolls of a rolling mill stand, usually for the driven rolls, wherein;

the drive-side roll journal portion of the working roll is stepped to provide a centering roll portion;

axial bearing means is mounted on and engages the centering roll portion to shift the roll axially;

a bearing housing is provided for said axial bearing means;

at least one hydraulic cylinder is connected to the bearing housing; and a spindle head can be slipped over a complementary end of the roll and connected to a driven spindle for imparting motive power to the spindle head.

The device provides a single connection for mounting of the rolls which need to be moved so that they can generally be disconnected or released in direct, simple, and very rapid manner.

Accordingly, the drive units effecting the movement, particularly axially directed shifting, of the rolls, can be disposed directly on the side with the drive of the mill, and about the drive spindle and the spindle heads respectively. These drive units require only a small space and, furthermore, remain in position on the frame when a replacement of the pair of rolls is carried out.

The working rolls are easily detachable, and it is only necessary to extend slightly the journal portion thereof, so that it is somewhat longer than customary for rolls which are not axially shiftable.

Thus, according to the invention, an actuator device for axially shifting powered rolls which are journalled by way of radial bearings in holding elements of a rolling mill frame, by means of hydraulic cylinders, comprises a centering roll portion, formed as a step on the driven end of the roll. Axial bearings are mounted in bearing housings and brace a central flange or rib of the centering roll portion between them. To each housing is coupled a hydraulic cylinder. The bearing housing is held in place by a wedge structure engaged by a slipped-on spindle head of the driving spindle.

The hydraulic cylinders of the two working rolls are arranged anti-parallel with respect to the plane containing the working roll axes. One connecting point of the hydraulic cylinder is connected to a lever arm of an angular or bell-crank lever. The axial-bearing housing is connected by a rod at a horizontal pivot normally aligned with the working roll axis to the other lever arm.

The opposite or other connecting eye of the hydraulic cylinder is connected by means of a pin to a fixed frame and/or a frame beam of the roll stand.

One lever arm of the angular lever advantageously in a forklike manner engages an eye of the associated hydraulic cylinder. The angled lever arms can form two parallel arms which laterally bracket the bearing housing as well as the spindle head. These arms are connected by means of the rods, respectively on both sides to the bearing housings.

The spindle head has wedge-shaped guides diverging toward the roll and form-locking engageable wedge plates on a flattened stub or stub following the centering roll portion. These plates are supported axially between two annular collar surfaces of the roll journal portion and during extraction of the spindle head release themselves radially from these spindle heads.

One of the annular collar surfaces is formed by a step of the roll journal portion and the other is formed by a projecting flank of a ring which is fitted onto the roll journal portion.

The spindle head has springs with or without centering pins which serve to stress the projections of the wedge plates generally axially in the direction towards the bearing housing.

Releasable holding elements can be associated with the spindle head. These holding elements can include hydraulic cylinders which operate holding jaws swingable by lever arms towards the spindle head.

The holding jaws can include projecting clamping bars which can form-locking engage in grooves of the spindle head. The holding element can be associated with tie bars which release the holding element in the retracted condition for removal and in a first relative position with respect to guide bars non-removably lock the holding element with clearance, while in a second relative position the holding elements are released for axial shifting.

The bearing housings can include guide bars adapted to engage into the horizontal guides of the guide pieces. The bearing housings can be connected to guide strips of the radial bearing by connecting bars and links.

BRIEF DESCRIPTION OF THE DRAWING

The above and other objects, features and advantages of my present invention will become more readily apparent from the following description, reference being made to the accompanying highly diagrammatic drawing, in which.

SPECIFIC DESCRIPTION

Figure 1:
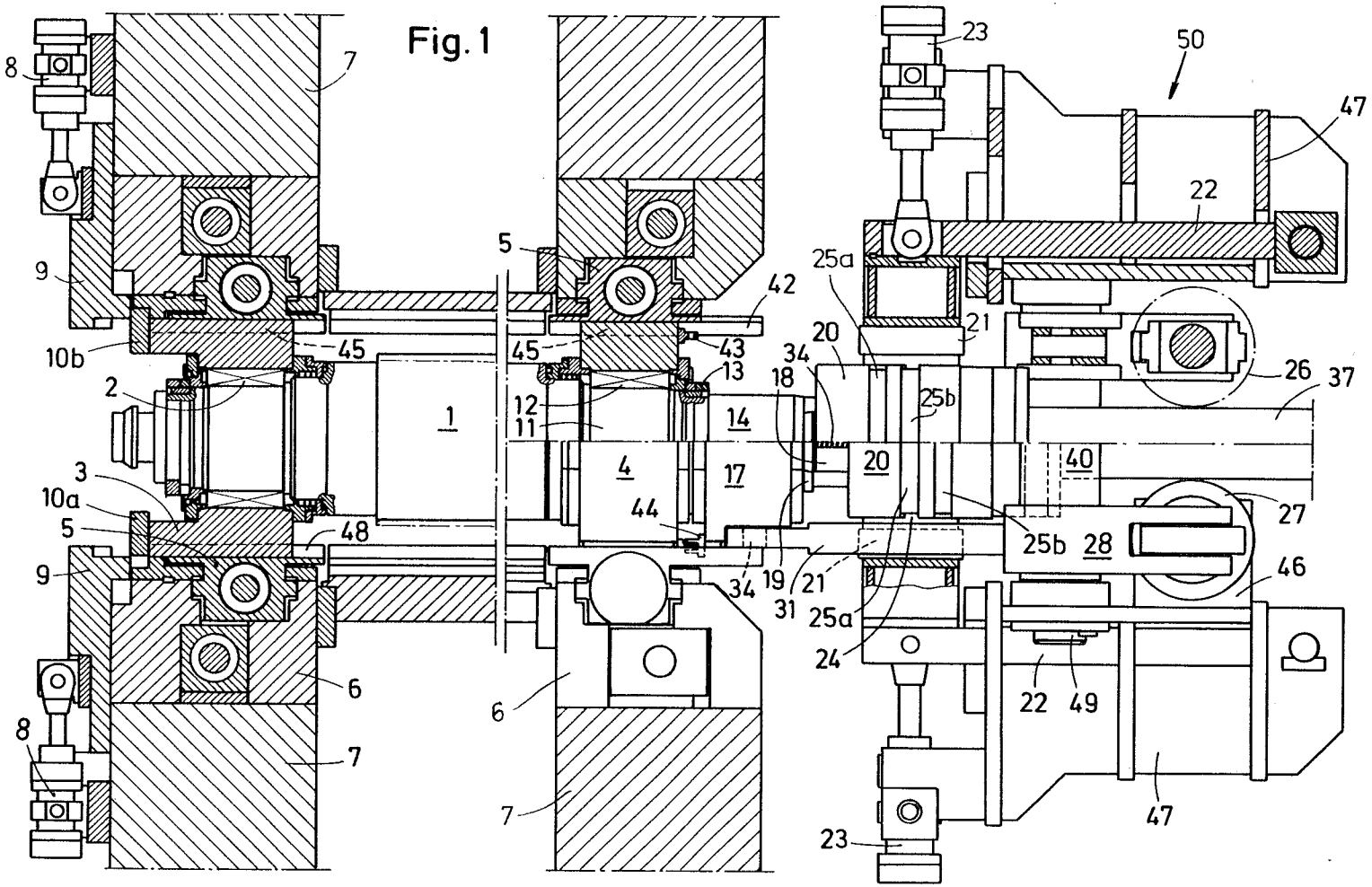
FIG. 1 is a schematic horizontal section through a rolling mill frame in which the rolls are shown in part only, and wherein the spindle heads are fixed for introduction of the rolls.

A working roll 1 is shown in the sectional view of FIG. 1, and this roll 1 is journalled in radial bearings 2 and 12 of respective holding elements 3 and 4. Respective lateral guide strips 45 of the holding elements 3 and 4 correspondingly engage horizontal guides 48 and 42 of the guide pieces 5.

The guide pieces 5, in turn, are guided in prism guides of cylinder blocks or chocks 6 arranged at support beams 7. The cylinder blocks 6 and the guide pieces 5 are equipped with hydraulic piston and cylinder units, as will be described in greater detail below.

On the side of the operator, forwardly of the support beams 7 (left side in FIG. 1) there are provided hydraulic piston and cylinder units 8 which actuate the associated two-stage tie bars 9, for limitation of the axial stroke or movement (to and fro) of the holding elements 3 and 4 and, consequently, of the working rolls 1. At the upper portion of the drawing, the asymmetric guide bar **10*b* is connected to its holding element 3 by a threaded connection in such a way that when the upper tie bar 9 is raised, the guide bar 10*b* is fixed with a certain amount of free play by the advanced tie bar 9**.

However, in the case of axially moveable working rolls, a guide bar is mounted, as shown by way of the guide bar **10*a*, so that only in the second stage of movement of the tie bar 9** is the axial stroke or movement of the working roll limited.

On the drive side there is provided the roll journal portion 11 which is journalled, as already mentioned, by way of the radial bearing 12 in the respective holding element 4. The journal portion 11 extends to the exterior or drive side by way of a grooved section, and a split ring 13 is mounted in the respective groove. The working roll 1 also has a centering roll portion 14 with a smaller diameter.

Figure 2:
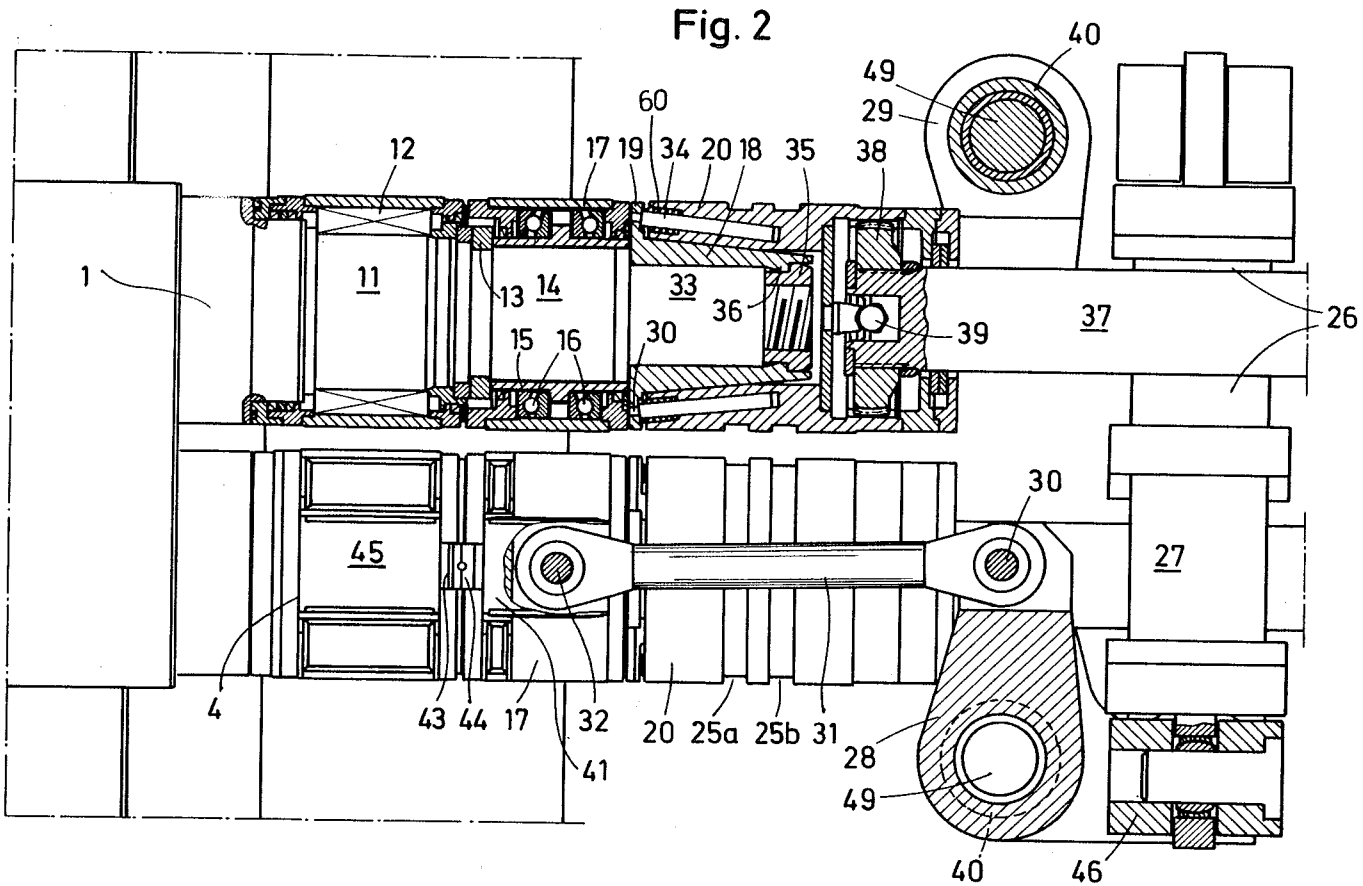
FIG. 2 is a drive-side view partly broken away of two roll journal portions with the associated spindle heads in an offset vertical section taken along the upper horizontal axis of symmetry along the central axis of the roll and the spindle, and beneath the axis of symmetry in front of the holding element, as well as the spindle head, through the linking pins of a connecting rod.

As is shown in FIG. 2, a sleeve 15 is placed on the centering portion 14, and the sleeve 15 is equipped with axial or thrust bearings 16 which are enclosed by a bearing housing 17.

Projections 19 of wedge plates 18 contact at the outer flanks of the sleeve 15, which projections 19 are guided by means of prism guides in the spindle head 20, with the guiding towards the bearing housing 17 being done with a slight amount of divergence.

For extracting the working roll 1, the spindle head 20 is held, according to FIG. 1, by jaws 21 of a spindle head mounting assembly 50. The jaws 21 are arranged at lever arms 22, and they can be swung by means of hydraulic piston and cylinder units 23 in such a way with respect to the spindle heads 20 that their curved or arcuate clamping bars 24 are introduced into the groove **25*b* in the case of the axially shiftable working roll 1, as is shown in the upper portion in FIG. 1 in partial cross-section. On the other hand, in the lower portion in FIG. 1, for axially shiftable working rolls 1, there is selected a larger distance of retraction of the spindle head 20, and the clamping bars 24 engage in the respective groove 25*a***.

Accordingly, the spindle heads 20 are fixed as is generally indicated in FIG. 1. Upon conclusion of the replacement of the rolls or rollers, the spindle heads 20 are released by retracting the lever arms 22 through actuation of the respective hydraulic piston and cylinder units 23.

The motive power which serves to effect shifting of the working rolls is provided by the hydraulic piston and cylinder units 26 and 27, respectively. These are arranged in parallel to a vertical axis or plane of symmetry in which the working rolls are arranged, and in crossing or anti-parallel manner in such a way that the upper connection of the hydraulic cylinder 26 is swingably connected at a base, not shown, of a frame 47 arranged at the drive side of the frame for the mill.

The frame 47 can be of independent construction at the base, or can be additionally supported at the support beams. As can best be seen in FIG. 2, the lower connection point of the hydraulic piston and cylinder unit 27 (and 26 respectively) is connected to a free lever arm of a lower angular lever 28 which, in turn, is pivotally arranged at a swing pin 49. This swing pin 49 is secured at the frame whereas the other parallel lever arms or clevises of the angular lever 28 are attached by way of articulated rod pin 30, to the one end of the connecting rod 3I. The other end of the connecting rod 31 is secured, by way of the connecting pin 32, to the lower bearing housing 17, or the lower portion thereof.

The hydraulic piston and cylinder unit 26 which extends parallel with respect to the unit 27 is connected with its lower connecting point to a base 46 of the respective frame 47, and the upper connecting point is linked at the free lever arm of the upper angular lever 29. By way of the upper connecting rod 31 (not shown, but arranged likewise as the shown lower connecting rod), the piston and cylinder unit 26 is able to shift the bearing housing 17 of the upper working roll 1 in axial direction.

Thus, a very compact arrangement is achieved whereby, however, at the same time the individual components of the device are readily accessible so that they can be easily inspected and quickly and easily replaced or removed, as required.

As can best be seen in FIG. 2, the roll journal portion 11 directed towards the drive side is extended by the centering roll portion 14. It is further provided with connecting surfaces which are planar, parallel with respect to one another, and to the central axis, and which form stubs 33. The ends of the stubs 33 are stepped once more, and on each one thereof is connected a profile ring 35.

Wedge plates 18 are secured on the respective surfaces of a stub 33, and the wedge plates 18, accordingly, impart torque from the spindle head 20 to the working roll shaft portion 1. The torque is introduced to the spindle heads 20 from pinion-type systems by way of spindles 37 and curved teeth couplings 38. The curved teeth couplings 38 are centered, for this purpose, by way of a ball 39 connected to the spindle head 20, with the ball 39 being mounted in a centered bearing of the driven or driving spindle 37.

The hydraulic piston and cylinder units 26 and 27 are respectively attached to the angular levers 28 (29) by means of pins which are passed through the respective fork or clevis formation of the angular levers (not shown in detail). The angular levers are also connected to each one another by way of connecting tubes 40.

Accordingly, when the hydraulic piston and cylinder units 26 and 27 are pressurized they will turn the angular levers 28 and 29. The other lever arms each again end in a fork-like formation or clevis and the respective connecting rod ends are connected thereto, by means of the articulated rod pins 30. The connecting rods 31 are attached by the connecting pins 32 to the journal housing 17 for the axial or thrust bearing 16, for axially moving the respective journal housing 17.

Thus, when the connecting rods 31 are moved in the direction of the side of the operator for the mill, the stroke is transmitted via the connecting pin 32, the bearing housing 17, the axial bearing 16, the sleeve 15, and the split ring 13 to the flanks of the groove which receives the ring 13. Consequently, the force is transmitted to the roll journal portion 11 and its working roll 1.

When the connecting rod 31 is shifted in the other direction, this stroke is absorbed or transferred by the respective connecting pin 32 and its bearing housing 17. It is further transmitted through the thrust bearings 16 and the sleeve 15 to the projections 19 of the wedge plates 18. These, in turn, by means of the steep slopes of the cam formations 36, act upon the corresponding flank of the ring 35 and whereupon the roll journal portion 11 and, consequently, the working roll 1 are moved to the right hand side in FIG. 2.

The connections thus far described, namely those that can transmit the torque as well as axial movements, need to be disconnected during roll exchange operations. For this, initially by means of the mechanism responsible for shifting, that is by means of the hydraulic piston and cylinder units 26 and 27, the respective working roll 1 is shifted together with the spindle head 20 connected to it. Each groove 25*a* is positioned ahead of the clamping bar 24 of the jaw 21 of the respective spindle head mounting assembly.

When actuating the hydraulic piston and cylinder unit 23 thereof, the jaws are guided, with the respective clamping bar 24, towards the spindle head 20, so that this is fixed in the predetermined position. Next, by means of the hydraulic piston and cylinder units 26 and 27, the working rolls 1 are shifted in the direction indicated in FIG. 1, that is in the direction of the operator of the mill. In this operation, the wedge plates 18 are entrained by way of the flanks of the rings 35 which engage behind the cam formations 36 and they are extracted with concomitant movements in their guides of the spindle heads 20. Because these guides are inclined with a certain amount of divergence with respect to one another, the respective clamping plates are moved with a radially outwardly directed component, so that the cam formations 36 are moved above the end flank of the ring 35 and thereby release the ring 35.

Next, upon releasing the wedge plates 18 from the planar surfaces of the stub 33, and from the groove of the ring 35, the shifting device is put at rest. When now in the course of replacing a working roll, the roll is extracted, firstly, the centering roll portion 14 and, next, the stub 33 is moved or extracted through the sleeve 15, to the left. The sleeves 15 per se are supported by the axial bearings 16 in the bearing housings 17 which, in turn, are carried by laterally disposed guide bars 41. These guide bars are supported on the extended horizontal guides 42 of the guide pieces 5.

In order to positively preclude any undesired clamping or jamming, it is preferred to provide the guide bars 41 with more clearance than the guide strips 45 of the holding elements 3 and 4 which are also guided in the horizontal guides 48 and 42. The respective guide strips 45 also serve to ensure that during operation the bearing housings 17 are held so that they cannot rotate, and they do not twist the connecting rods 31.

An additional stabilizing effect is provided by springs 60 which pretension the wedge plates 18 in their direction of movement. The springs 60 surround centering pins 34 which are screwed to the projections 19, or which pass through them, and they serve to take care that upon extraction of a roll the wedge plates 18 can not slide back.

Further springs, not shown, serve to pretension, in axial direction, the spindles 37, and these springs provide a further stabilization and preclude undesired axial slipping of the spindle heads 20 and, consequently, undesired disconnecting of the wedge plates 18.

The introduction of the new roll set is done in the reverse sequence. The shaft portions which are provided ahead of the centering portion 14 are respectively pushed through the sleeve 15, and the flat stub 33 is pushed between the wedge plates 18 until the shoulder of the split ring 13 contacts the sleeve 15. Upon further introduction, the hydraulic piston and cylinder units 26 and 27 are simultaneously actuated in co-current manner, or they are depressurized by connecting their pressure spaces or chambers, so that the working rolls can now be moved, together with the sleeves 15 which are positioned on the centering portions 14, and this will move the wedge plates 18 as well.

On further introduction into the spindle head 20 the wedge plates 18 move, due to the inclination of their guides, towards one another so that the cam formations 36 engage in the preferably linear grooves of the rings 35, and the sleeves 15 are then axially fixed.

On pressurizing of the hydraulic piston and cylinder units 6 and 27 in the sense of moving the rolls in the direction of the operator's side (left side in FIG. 1), the forces exerted on the bearing housing 17 are transmitted through the thrust bearings 16 to the sleeves 15 which, in turn, contact the split rings 13 supported by a shoulder of the trunnion portion of the respective roll.

When shifting the bearing housing 17 in the direction of the drive side of the mill (right side in FIG. 1), they will also carry along their respective sleeves 15 which, by way of the projections 19 and the rings 35 carry along the journal portion 11.

Care has been taken particularly that the axial bearings 16 with their bearing housings 17 can be readily inspected and replaced as required. For inspection, the axial bearings 16 are extracted with the respective set of rolls. For this, initially, the guide strips 45 and the bearing housings 17 are connected to one another. This is done in the position when the roll is extracted on the drive side, whereby on both sides, through aligned passages, firstly, in connecting bars 43 arranged at the guide strips 45 and, secondly, in fork-like supports 44 provided at the bearing housings 17, respective pins are introduced to effect the respective connection.

This assembly procedure is further simplified by recesses in the central portion of the horizontal guide 42. Once the fully retracted position and removal condition has been reached, the connecting pins 32 which secure the connecting rods 31 to the bearing housing 17, are removed so that on further extraction of the set of rolls, the connecting rods 31 will remain behind, and the sleeves 15 are fully taken out together with the axial bearings 16, the respective bearing housings 17, and the roll set.

The bearing 16 is connected by way of a seal ring system 61 to the bearing 12. The bearing 12, in turn, is connected by a second seal system 62 at the working roll 1.

The invention provides a drive mechanism for axial shifting of respective rolls, particularly the working rolls which, on the one hand, is compact but which, on the other hand, can be readily disassembled into its component parts for inspection and required maintenance operations. Such maintenance operations can be readily carried out due to easy access.

There is no need to accommodate components in the holding elements and/or the support beams so that these are not weakened by recesses, and a relatively easy manufacture thereof is feasible.

The compact and reliable arrangement of the invention for axially moving the rolls requires little manufacturing effort and is easily operated. It does not require components which have to be disassembled and which consequently need not be reconnected, and allows a substantially automatic disconnection as well as reconnection of the attendant mechanical connections for the operation of the mill.

I claim:

1. In a rolling mill equipped with an actuator device for axially shifting driven rolls journaled by way of radial bearings in holding elements in a rolling mill frame, and equipped with means for imparting motive power to said actuator device, the improvement wherein:

a drive-side roll journal portion of each roll is stepped to define a centering roll portion adjacent to a drive portion, and a journal portion adjacent to said centering roll portion;

a radial bearing engages each of said journal portions;

an axial bearing engages each centering roll portion and including a sleeve receiving the respective said centering roll portion a bearing housing receives said axial bearing and is shiftable relative to said frame;

a hydraulic piston and cylinder is connected to each bearing housing for axially displacing same and the respective roll at the respective centering portion;

at least one spindle head is axially couplable to said drive portion and axially positions said housing upon being shoved onto said drive portion, said centering roll portion and said drive portion being retractable through said sleeve for replacement of the respective roll by removing it axially from the frame; and a driven spindle for imparting motive power is connected to said spindle head.

2. The improvement as defined in claim 1 wherein each said hydraulic piston and cylinder unit is connected at one end to a respective angular lever and the opposite end is connected to said frame, and further comprising:

means for pivotally mounting each angular lever at the rolling frame for swinging movement with respect to a horizontal axis of rotation.

said angular lever having at least one first connecting arm for attaching it to said at least one hydraulic piston and cylinder unit;

and having a second set of connecting arms for connecting it to said bearing housing; and connecting rods for connecting said second set of connecting arms and the bearing housing.

3. The improvement defined in claim 2 wherein said hydraulic piston and cylinder units are disposed in anti-parallel manner.

4. The improvement defined in claim 2 wherein pivot pins form pivotal connections between said housing and said rods between said rods and said second set of arms and between said first arm and said unit.

5. The apparatus according to claim 2 wherein at least one lever arm of said angular lever has a fork-like formation to connect it to the respective end of the associated hydraulic piston and cylinder unit, and wherein said second set of lever arms includes two parallel arms which extend laterally with respect to said bearing housing and said spindle head and which are connected by way of respective connecting rods to said housing.

6. The improvement defined in claim 2 wherein each said spindle head includes wedge-shaped guide formations which diverge toward the centering position, wedge plates being movably arranged in said guide formations, but adapted to be positively locked in place with the planar surfaces of said drive portion, said wedge plates being supported axially at respective shoulders of the respective roll and during extraction of said spindle head said wedge plates being radially released from said spindle head.

7. The improvement defined in claim 6 wherein at least one of said shoulders is provided by a step of the roll, and at least one shoulder is provided by a projecting flank of a ring mounted on the roll.

8. The improvement defined in claim 6 wherein said wedge plates include projections, further comprising:

resilient biasing means; and centering pins for mounting said biasing means in said spindle head for pretensioning the respective projections of said wedge plates in the direction generally axially towards said bearing housing.

9. The improvement defined in claim 6, further comprising releasable holding elements for said spindle head.

10. The improvement defined in claim 9 wherein said holding elements include:

actuatable lever arms mounted at the rolling mill frame;

holding jaws respectively connected at said lever arms, but capable of carrying out swinging movements towards said spindle head; and hydraulic piston and cylinder units secured to said holding jaws.

11. The improvement defined in claim 10 wherein said holding jaws include projecting clamping bars which can be connected in positive manner in respective grooves of said spindle head.

12. The improvement defined in claim 6 further comprising:

guide bars for said holding elements; and tie bars for said holding elements, said tie bars being arranged to assume a first position, a retracted position, and a second position, and said tie bars in the retracted position releasing the respective holding elements for removal thereof, and in the first position with respect to said guide bars, said tie bars retain the respective holding elements with clearance in irremovable manner, while in said second position the holding elements are released for the respective movement of the axially directed shifting of respective rolls.

13. The improvement defined in claim 6 and further comprising:

guide pieces for said holding elements, said guide pieces including horizontal guides; and guide bars operatively connectable to the bearing housing of said axial bearing means, and adapted to engage said horizontal guides for said guide pieces.

14. The improvement defined in claim 13 and further comprising:

guide strips for said guide pieces; and means for connecting said bearing housings and said guide strips, said means including supports and connecting bars.

15. The improvement defined in claim 6 wherein said axial bearing means is a thrust bearing.

16. The improvement defined in claim 15 wherein said thrust bearing is mounted on said sleeve which is fixed on said centering position between a split ring and said spindle head.

* * * * *